United States Patent [19]

Iba

[11] Patent Number: 4,653,374

[45] Date of Patent: Mar. 31, 1987

[54] ELECTRONIC MUSICAL INSTRUMENT WITH A BENDER PROVIDED SEPARATELY FROM PERFORMANCE KEYS

[75] Inventor: Akio Iba, Tokorozawa, Japan

[73] Assignee: Casio Computer Co., Ltd., Tokyo, Japan

[21] Appl. No.: 702,469

[22] Filed: Feb. 19, 1985

[30] Foreign Application Priority Data

Feb. 24, 1984 [JP] Japan ..... 59-32706

[51] Int. Cl.[4] ..... G10H 1/02; G10H 1/055; G10H 1/043

[52] U.S. Cl. ..... 84/1.01; 84/1.24; 84/1.25

[58] Field of Search ..... 84/1.01, 1.1, 1.24, 84/DIG. 10, 1.25, 1.26

[56] References Cited

U.S. PATENT DOCUMENTS 3,609,203 9/1971 Adachi ..... 84/DIG. 10
4,099,438 7/1978 Hiyoshi et al. ..... 84/1.25
4,179,971 12/1979 Takahashi et al. ..... 84/1.24
4,337,681 7/1982 Deutsch et al. ..... 84/DIG. 2
4,343,218 8/1982 Futamase .
4,375,276 3/1983 Okamoto .
4,498,365 2/1985 Tripp et al. ..... 84/1.24

FOREIGN PATENT DOCUMENTS 2518633 10/1975 Fed. Rep. of Germany .

*Primary Examiner*—S. J. Witkowski
*Assistant Examiner*—David Warren
*Attorney, Agent, or Firm*—Frishauf, Holtz, Goodman & Woodward

[57] ABSTRACT

A digital pitch bend signal is supplied from an A/D converter to a first coefficient multiplier for every predetermined sampling period. An output of the first coefficient multiplier is added with an output of a second coefficient multiplier at an adder an output of which is delivered, as a digital pitch bend signal in the present cycle, from a buffer for the tone generation. The output of the adder is also fed back to an input of the second coefficient multiplier. Thus, from the buffer, a converted pitch bend signal having a value corrected during the respective sampling periods is produced.

10 Claims, 14 Drawing Figures

FIG. 5
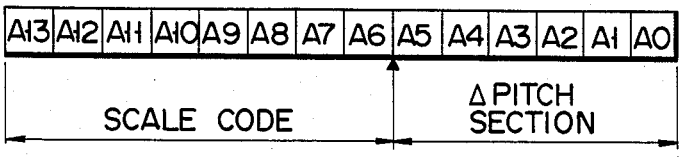
FIG. 6
| | |
|---|---|
| $C_1$ | C |
| $C_1^{\#}$ | D |
| $D_1$ | E |
| $D_1^{\#}$ | F |
| $E_1$ | 10 |
| ⋮ | ⋮ |
| $A_5^{\#}$ | 45 |
| $A_5$ | 46 |
| $B_5$ | 47 |
| $C_6$ | 48 |
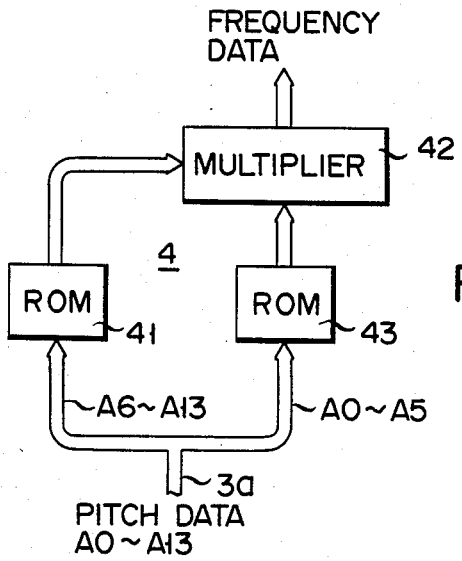
FIG. 7

FIG. 8

| KEY CODE BIT | CENT(¢) | BINARY REAL DATA (DECIMAL) |
|---|---|---|
| A0 | 1.6625 | 1.000902943($=2^{1.5625/1200}$) |
| A1 | 3.125 | 1.001806701($=2^{3.125/1200}$) |
| A2 | 6.25 | 1.003616666($=2^{6.25/1200}$) |
| A3 | 12.5 | 1.007246412($=2^{12.5/1200}$) |
| A4 | 25 | 1.014545335($=2^{25/1200}$) |
| A5 | 50 | 1.029302237($=2^{50/1200}$) |
| A6 | 100 | |
| A7 | 200 | |
| A8 | 400 | |
| A9 | 800 | |
| A10 | 1600 | |
| A11 | 3200 | |
| A12 | 6400 | |
| A13 | 12800 | |

FIG. 9

| BINARY CODE A5 A4 A3 A2 A1 A0 | BINARY REAL DATA |
|---|---|
| 0 0 0 0 0 0 | 1.0000000000 ($=2^{0/1200}=1.000000$) |
| ∫ | ∫ |
| 1 1 1 1 1 1 | 1.0000111011 ($=2^{98.4375/1200}=1.058507$) |

| Δ PITCH | γ16 | γ'16 |
|---|---|---|
| SEMITONE X1 | 00·0204081 | 00·020 |
| " X2 | ·0408102 | ·041 |
| " X3 | ·060C183 | ·061 |
| " X4 | ·0810204 | ·081 |
| " X5 | ·0A14285 | ·0A1 |
| " X6 | ·0C18306 | ·0C2 |
| " X7 | ·0E1C387 | ·0E2 |
| " X8 | ·1020408 | ·102 |
| " X9 | ·1224489 | ·122 |
| " X10 | ·142850A | ·143 |
| " X11 | ·162C58B | ·163 |
| " X12 | ·183060C | ·183 |

| V | A | B |
|---|---|---|
| 00 | 80 | 7F |
| 01 | 81 | 7E |
| 02 | 82 | 7D |
| | | |
| 7E | FE | 01 |
| 7F | FF | 00 |
| 80 | 00 | 00 |
| 81 | 01 | 01 |
| | | |
| FD | 7D | 7D |
| FE | 7E | 7E |
| FF | 7F | 7F |

(−)
(+)

ELECTRONIC MUSICAL INSTRUMENT WITH A BENDER PROVIDED SEPARATELY FROM PERFORMANCE KEYS

BACKGROUND OF THE INVENTION

This invention relates to an electronic musical instrument such as a music synthesizer with a bender.

Music synthesizers are usually constructed such that several pitch variations are given to the generated tone by operating a pitch bend wheel. However, slight variations of the pitch of the output tone are liable to result even when the music synthesizer is played without operating the pitch bend wheel. This is caused by output characteristics of an analog-to-digital (A/D) converter which is used to convert the analog output signal from the pitch bend into a digital signal. For example, in the case of a successive approximate type A/D converter, the least significant bit (LSB) of the digital output of the A/D converter is influenced by errors of resistor elements used in the A/D converter so that it randomly takes value "1" or "0".

Meanwhile, in the A/D converter, the pitch bend output is sampled and digitally converted in a constant cycle, e.g., 8 milliseconds. Therefore, when the pitch bend wheel is quickly operated in the sampling cycle period of 8 milliseconds, the A/D converter output cannot correctly follow the pitch bend effect. To cope with this deficiency, the sampling cycle may be reduced. In this case, the time exclusively used for the pitch bend processing among the operation time of a CPU which controls the operation of the music synthesizer is increased, which is liable to have an adverse effect on the control of operation of the entire music synthesizer.

SUMMARY OF THE INVENTION

An object of the invention is to provide an electronic musical instrument with a bender, which can operate stably and provide a smooth bend effect such as pitch bend effect at all times and yet have a simple construction.

According to the invention, there is provided an electronic musical instrument with a bender comprising:

means for providing a digital bend signal for each fixed period;

converting means for subjecting every bend signal to a predetermined data conversion processing to produce a converted bend signal; and means for generating a tone having a bend corresponding to the converted bend signal;

the converting means including means for performing a predetermined calculation on the converted bend signal provided in the preceding cycle and the digital bend signal provided in the present cycle to generate the converted bend signal of the present cycle, thereby obtaining a converted bend signal having a value obtained during each output cycle period of the digital bend signal.

BRIEF DESCRIPTION OF THE DRAWINGS

FIG. 5 is a view showing a pitch data format;

FIG. 6 is a view showing scale codes of notes C1 to C6;

FIG. 7 is a block diagram showing a specific construction of a tone generation section shown in FIG. 1;

FIG. 8 is a view showing a correspondence relation between cent values of key code bits and binary real data;

FIG. 9 is a view showing binary real data corresponding to code data of a change-in-pitch or a Δ pitch section shown in FIG. 5;

DETAILED DESCRIPTION OF THE PREFERRED EMBODIMENT

Figure 1:
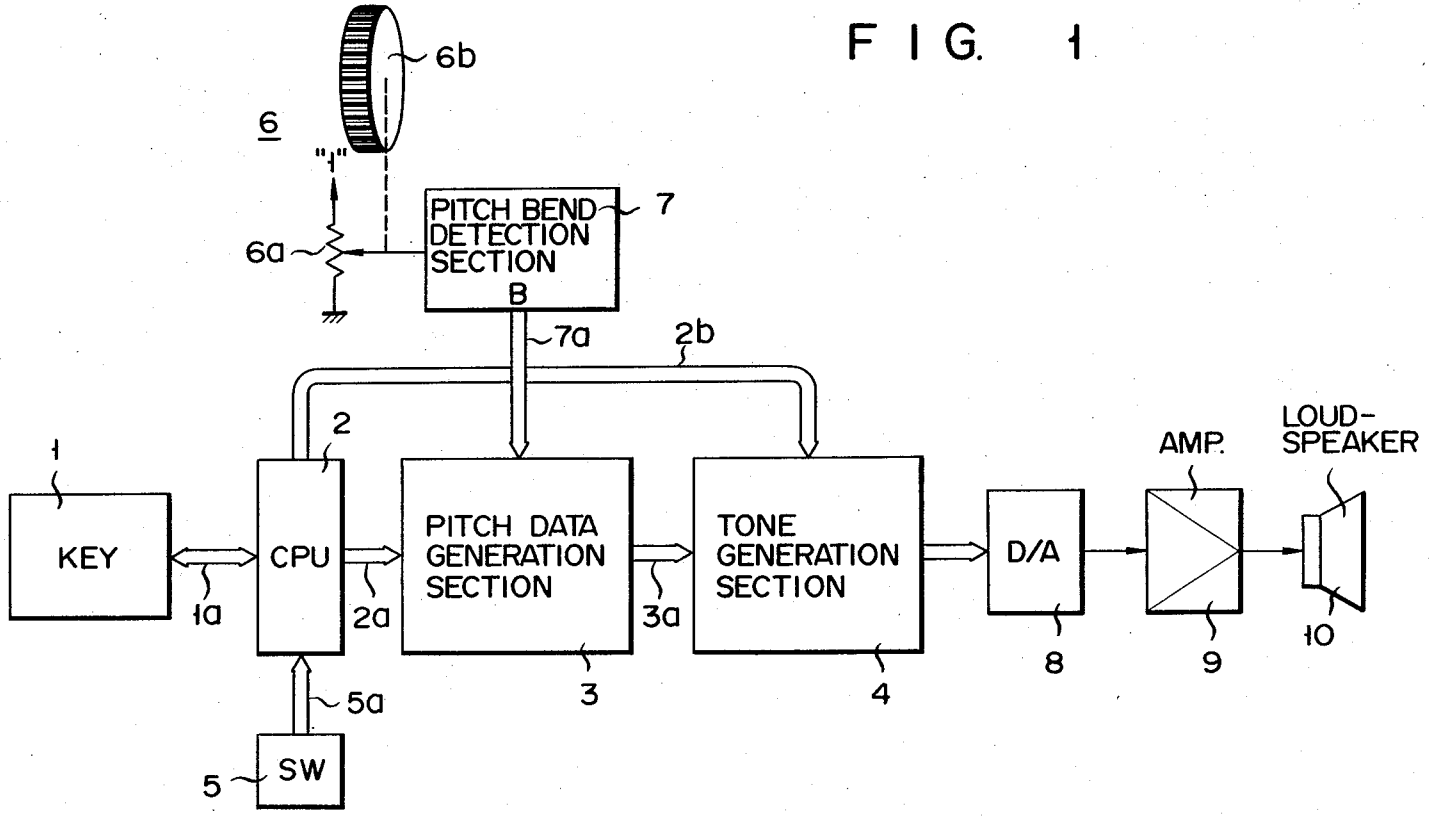
FIG. 1 is a block diagram showing an embodiment of the electronic musical instrument with a pitch bend according to the invention.

An embodiment of the invention will now be described in detail with reference to the drawings. Referring to FIG. 1, there is shown an electronic musical instrument with a pitch bend. A keyboard 1 of the instrument has 61 performance keys for C1 to C6 approximately covering 5 octaves. The performance keys are scanned by a CPU 2 which controls the operation of the engine electronic musical instrument with a pitch bend. When a key on the keyboard 1 is operated, a key signal is fed to the CPU 2 through a line 1*a*, and corresponding key code data is supplied from the CPU 2 to a pitch data generation section 3 through a line 2*a*. At the same time, an on-off signal for each key is supplied from the CPU 2 to the tone generation section 4 through the line 2*b*.

The CPU 2 consists of a microprocessor, and it fetches various switch outputs from a switch section 5 through a line 5*a* and feeds corresponding tone generation data to the pitch data generation section 3 and tone generation section 4. The switch section 5 has various timbre designation switches, chord designation switches and rhythm designation switches. It further has a maximum pitch bend variation range designation switch to be described later.

A variable resistor 6*a* constitutes a pitch bend 6. One of its fixed terminals is connected to a power supply which provides a logic level "1", and the other fixed terminal is grounded. A variable or tap terminal of the variable resistor 6*a* is coupled to a shaft of a pitch bend wheel 6*b* and moved with the rotation thereof. The output of the pitch bend 6 is provided from the tap terminal of the variable resistor 6*a* and fed to a pitch bend detection section 7.

In the pitch bend detection section 7, a DC voltage from the pitch bend 6 is converted to digital data which is further processed for conversion to be described later to obtain converted pitch bend data. The converted pitch bend data is supplied to the pitch data generation section 3 through a line *7a*, and pitch data with a predetermined pitch bend provided according to the key code data and converted pitch bend data is fed to the tone generation section 4 through a line *3a*.

In the tone generation section 4, a tone signal at a predetermined frequency is produced according to the pitch data and also to a key on-off data and tone generation data for providing timbre, chord and rhythm supplied from the CPU 2, and it is fed to a D/A converter 8. The D/A converter 8 produces an analog signal which is coupled through an amplifier 9 to a loudspeaker 10 to be sounded.

Figure 2:
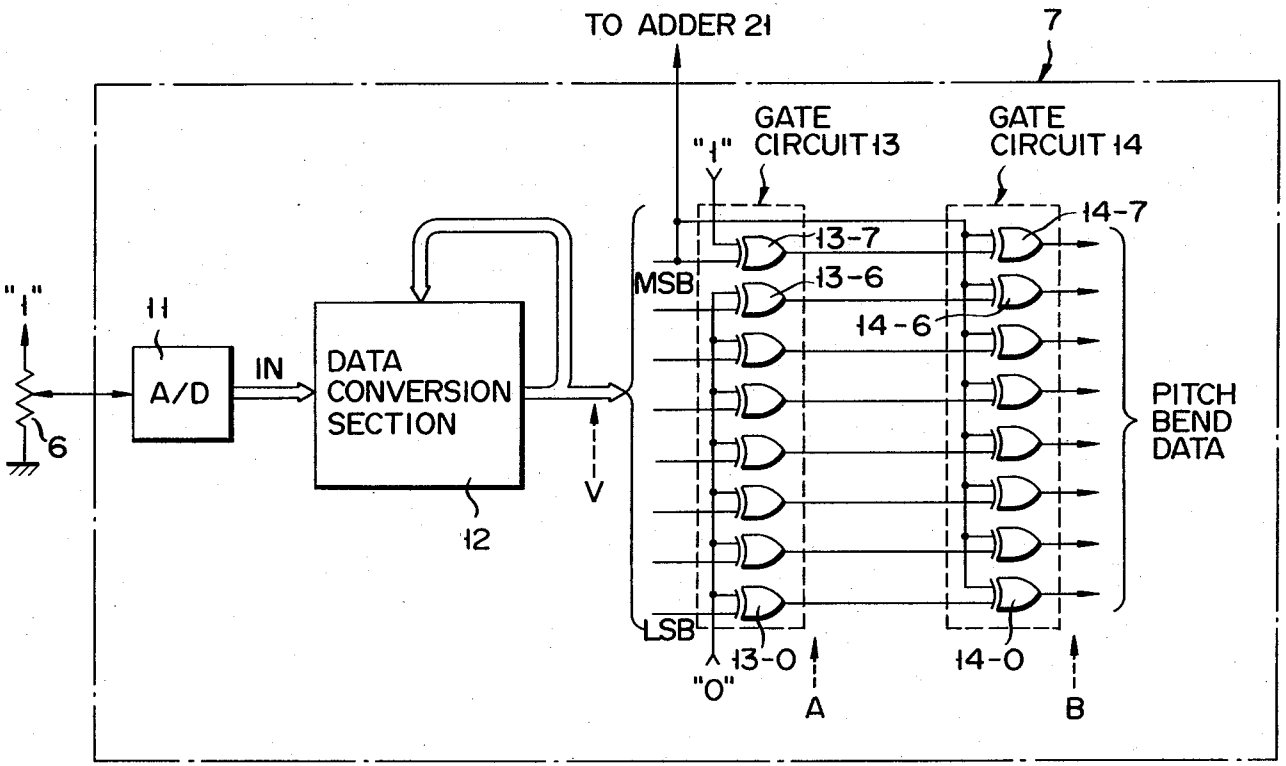
FIG. 2 is a block diagram showing a specific construction of a pitch bend output detection section shown in FIG. 1.

FIG. 2 shows a specific construction of the pitch bend detection section 7. Referring to the Figure, the output of the pitch bend 6 is fed to an A/D converter 11 for conversion to digital pitch bend data IN. The pitch bend data IN is fed to a first input terminal of a data converter 12. The specific construction and operation of the data converter 12 will be described later with reference to FIG. 3.

The data converter 12 produces converted data V, which is fed to a second input terminal of the data converter 12 and also to a first gate circuit 13. In this embodiment, the converted data V has 8 bits from the LSB (least significant bit) to the MSB (most significant bit), and it is coupled to one input terminal of each of exclusive OR gates 13-0 to 13-7 of the first gate circuit 13. A signal of logic level "0" is fed from a signal source (not shown) to the other input terminal of each of the exclusive OR gates 13-0 to 13-6, and a signal of logic level "1" is fed to the other input terminal of the remaining exclusive OR gate 13-7. The converted data V fed to the first gate circuit 13 is fed as data A with only the MSB inverted to a second data circuit 14. The second data circuit 14 consists of 8 exclusive OR gates 14-0 to 14-7. The MSB of the converted data V is commonly fed to one input terminal of each of the gates 14-0 to 14-7. To the other input terminals of the gates 14-0 to 14-7 are fed corresponding bit signals of the data A. Thus, an MSB signal of "1" is obtained from the gate 14-7 at all times. When the MSB of the converted data V fed to the first gate circuit 13 is "1", inverted bit data as of the outputs of the gates 13-0 to 13-6 is obtained from the gates 14-0 to 14-6. When the MSB of the converted data V is "0", non-inverted bit data corresponding to the inputs to the other input terminals of the gates 14-0 to 14-6 is obtained. The inverted or non-inverted bit data and the MSB output of the gate 14-7 are fed as pitch bend data B to the pitch data generation section 3 through a line *7a*.

Figure 3:
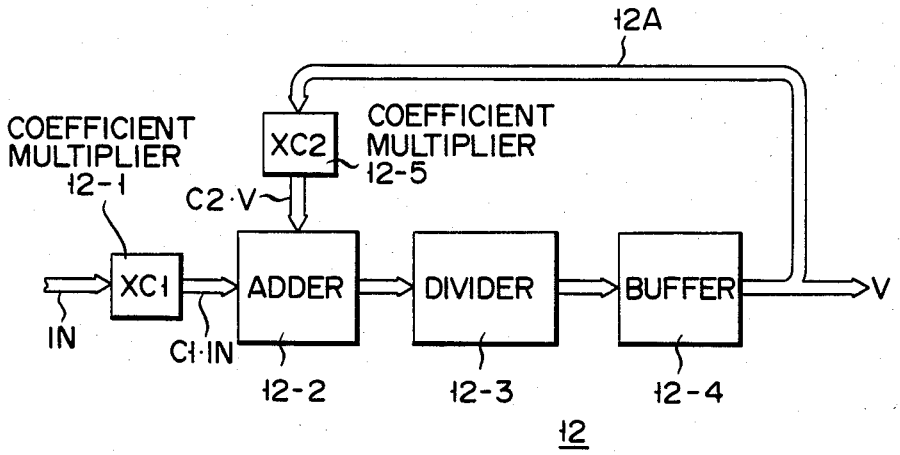
FIG. 3 is a block diagram showing a specific construction of a data conversion section shown in FIG. 2.

The specific construction of the data converter 12 will now be described with reference to FIG. 3. The output data IN of the A/D converter 11 shown in FIG. 2 is fed to a coefficient multiplier 12-1, as shown in FIG. 3, to be multiplied by a predetermined coefficient C1. In this embodiment, the coefficient C1 is set to C1=1.

The output data C1·IN from the multiplier 12-1 is fed to one input terminal of an adder 12-2. The output data of the adder 12-2 is fed to a divider 12-3 to be divided by a predetermined number m. The division output of the divider 12-3 is fed to a buffer 12-4 to be divided to one-half. The output data of the buffer 12-4 constitutes the converted data V which is fed to another coefficient multiplier 12-5 through a line 12A. The multiplier 12-5 multiplies the converted data V by a predetermined coefficient C2. In this embodiment, the coefficient C2 is set to C2=1. The output data C2·V of the multiplier 12-5 is fed to the other input terminal of the adder 12-2.

The adder 12-2 thus provides sum data (C1·IN+C2·V) of the data C1·IN, which is the product of the prevailing cycle input data IN and coefficient C1, and the data C2·V, which is the product of the preceding cycle converted data V and coefficient C2. The sum data (C1·IN+C2·V) is divided by the divider 12-3 to one half (m=2 in this case) and provided as next cycle converted data from the buffer 12-4.

The calculation for obtaining the converted data $V_{(n+1)}$ of the (n+1)-th cycle from the converted data $V_n$ of the n-th cycle and data $IN_{(n+1)}$ of the (n+1)-th cycle (n being n=0, 1, 2, . . . ) is generally represented as $$V_{(n+1)}=(C1\cdot IN_{(n+1)}+C2\cdot Vn)/m \quad (1)$$

In this embodiment, C1=1, C2 =1 and m=2, the equation (1) can be rewritten as $$V_{(n+1)}=(IN_{(n+1)}+Vn)/2 \quad (2)$$

Thus, the converted data $V_{(n+1)}$ of the present cycle is obtained as the average value of the present cycle data $IN_{(n+1)}$ and preceding cycle data $V_n$.

Figure 4:
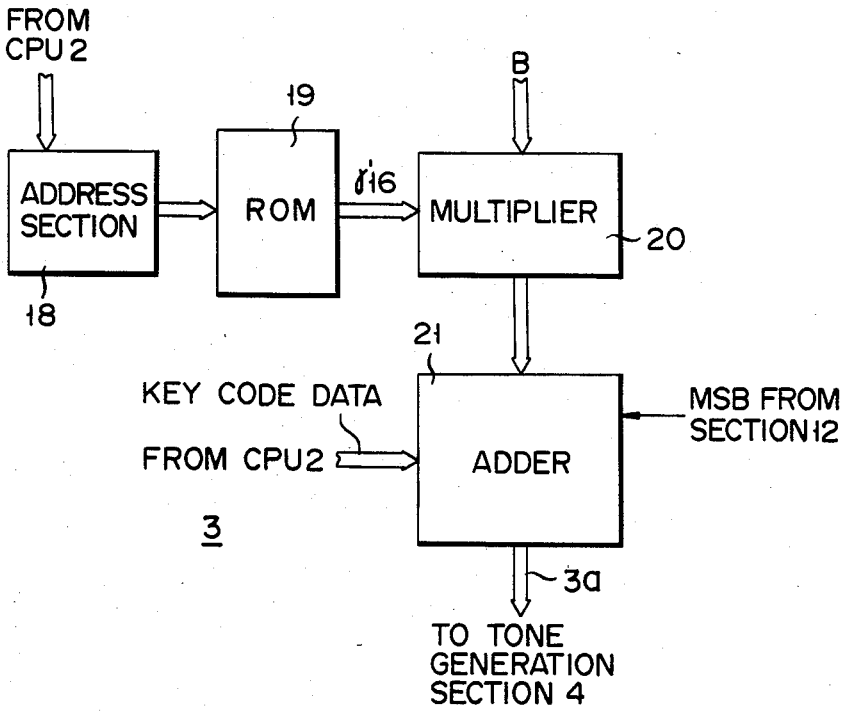
FIG. 4 is a block diagram showing a specific construction of pitch data generation section.

A specific example of the pitch data generation section 3 will now be described with reference to FIG. 4. The maximum pitch bend variation range is set in semitones as units by the maximum pitch bend variation range setting switch provided in the switch section 5. It is assumed here that the range is set such that the pitch bend is varied by the wheel *6b* three times the semitone, i.e., at an interval corresponding to a one-and-a-half tone. The output of the setting switch is fed to the CPU 2, which thus feeds data corresponding to a one-and-a-half tone to an address section 18 for generating address data. The address section 18 produces address data corresponding to the input data, the address data being fed to a ROM 19. In the ROM 19, a plurality of maximum pitch bend variation range data are stored at an interval of a halftone. In this case, data corresponding to a one-and-a-half tone is read out from the ROM 19. The readout data is expressed as a hexadecimal code and denoted as $\gamma'_{16}$.

The maximum pitch bend variation range data $\gamma'_{16}$ thus read out is fed along with the pitch bend data B to a multiplier 20, which produces the product $\gamma'_{16}\times B$ of the two inputs. Thus, pitch bend data $\gamma'_{16}\times B$ which is determined by the designated maximum pitch bend variation range, is fed to one input terminal of an adder 21. To the other input terminal of the adder 21 is fed a key code data, which is provided from the CPU 2 and represents the note of the operated key on the keyboard 1. The adder 21 adds the two inputs and feeds the sum data as pitch data to the tone generation section 4 through a line *3a*. The MSB of the converted data V from section 12 is supplied to an arithmetic control terminal of the adder 21. This MSB is either "1" or "0" depending on whether the wheel *6b* is turned forwards or backwards from its intermediate position. When the MSB "1", the pitch bend data $\gamma'_{16}\times B$ is added to the key code data. When the MSB is "0", the data $\Theta'_{16}\times B$ is subtracted from the key code data.

The pitch data gives cent frequency data, as will be described later, and the tone generation section 4 is constructed such that a pitch bend is provided in the same ratio to any key on the keyboard 1.

FIG. 5 shows the format of the pitch data provided from the adder 21 in the pitch data generation section 3. As is shown, the pitch data consists of 14 bits A0 to A13. Of these bits, the lower 6 bits A0 to A5 constitute a Δ pitch section which represents a code of a frequency lower than a semitone, the code being represented by the unit of a predetermined cent. The remaining upper 8 bits A6 to A13 constitute a scale code representing a unit of semitone. The scale code is a hexadecimal code as shown in FIG. 6, which gives each of the notes C1 to C6 of all the 61 performance keys on the keyboard 1 in this embodiment.

The construction of the tone generation section 4 is shown in the block diagram of FIG. 7. In the tone generation section 4, frequency data with pitch bend is obtained in correspondence to a depressed performance key according to first frequency data corresponding to a hexadecimal scale code from the CPU 2, as shown in FIG. 6, and data giving a pitch bend frequency in cent proportion to the first frequency data according to the Δ pitch code data of the Δ pitch section. A given tone signal is produced from the frequency data thus obtained.

Of the pitch data bits A0 to A13 as shown in FIG. 5, obtained from the pitch data generation section 3, the scale code consisting of the upper 8 bits A6 to A13 is fed as address data to a first ROM 41. In the ROM 41, frequency data different from an interval of a semitone is preliminarily stored. Frequency data corresponding to the scale code data is read out from the ROM 41 and fed to one input terminal of the multiplier 42.

Meanwhile, the Δ pitch code data consisting of the lower 6 bits A0 to A5 is supplied as address data to a second ROM 43. Cent data which is expressed as a binary code is converted into a binary real data as shown in FIG. 8.

The frequency data provided from the ROM 41 and binary real data corresponding to the Δ pitch code data provided from the ROM 43 are fed to a multiplier 42. The multiplier 42 provides frequency data with the pitch bend in cent proportion to the note of the depressed key. The frequency data with the pitch bend is obtained as the mixed data of the frequency data corresponding to the note of the depressed key and the frequency data with the cent proportion pitch bend. The obtained frequency data is successively accumulated and the accumulated frequency data is used to determine a phase of a tone waveform to obtain a pitch-bended tone signal from the tone generation section 4.

FIG. 8 shows the correspondence relation between the pitch data bits A0 to A13 and cent values. The binary real data of the Δ pitch section, as shown in FIG. 5, can be obtained as decimal data by using this correspondence relation. The binary code bit data A0 to A5 shown in FIG. 8 is variable from "000000" to "111111", i.e., from 0 cent to 98.4375 (=50+25+12.5+6.25+3.125+1.5625) cents. Using this, the data is converted into binary real data as shown in FIG. 9 with the ROM 43. For example, the binary real data for 50 cents in FIG. 8 has a value of 1,029302237, i.e., 1+0.029302237, and by multiplying this data by the output data from the ROM 41, the required pitch data can be immediately obtained.

The data $\gamma'_{16}$ that is read out from the ROM 19 shown in FIG. 4 will now be described with reference to FIGS. 10 and 11.

Figures 10, 11:
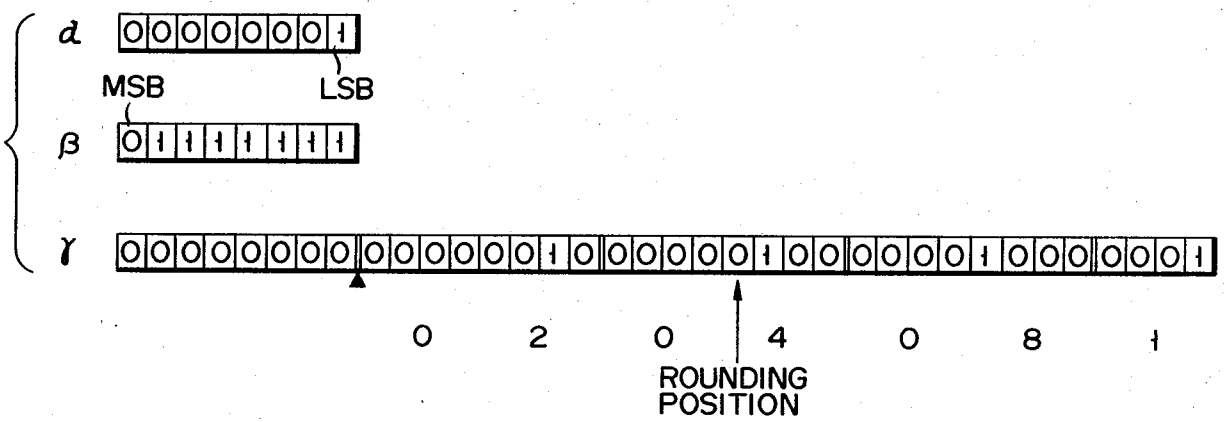
FIGS. 10 and 11 are views for explaining a process of obtaining data representing a designated maximum pitch bend variation range given in units of semitones.

Referring to FIG. 10, the 8-bit data "00000001" shown at $\alpha$ is the pitch bend data from the pitch bend 6 and represents a semitone. The data "01111111" shown at $\beta$ is the output of the maximum pitch bend variation range setting switch of the switch section 5 and represents the maximum variation range of the pitch bend. The MSB of "0" of this data is a sign bit. Shown at $\gamma$ is the change in pitch per bit of the pitch bend, which is obtained as a result of division of the data $\alpha$ by the data $\beta$. This value is expressed by the hexadecimal expression as $\gamma_{16}=0.0204081$ and, by rounding at the illustrated place, 0.020 is obtained. That is, the data $\gamma'_{16}$ is 0.020 when the maximum pitch bend variation range corresponds to a semitone.

FIG. 11 shows data $\gamma_{16}$ and $\gamma'_{16}$ pitch bend variation range corresponds to once to twelve times a semitone, as obtained in the manner as described in connection with FIG. 10. The 13 different data $\gamma'_{16}$ expressed as multiples of a semitone as shown in FIG. 11, are stored in the ROM 19.

The operation of this embodiment will now be described with reference to FIGS. 12 to 14. Before the start of performance, the maximum pitch bend variation range is set to a desired value, e.g., three times a semitone, by operating the switch in the switch section 5. The CPU 2 processes the output that is provided as a result of the setting, and it feeds to the address section 18 in the pitch data generation section 3 data for producing address data for reading out the data $\gamma'_{16}$ corresponding to three times a semitone from the ROM 19. Thus, data of $\gamma'_{16}=0.061$ is read out from the ROM 19. This data $\gamma'_{16}$ is fed to the multiplier 20 to be multiplied by the pitch bend data B. Thus, when any key on the keyboard 1 is depressed, the note pitch of that key may be varied by the one-and-a-half tone at the most in either ascending or descending direction as the pitch of the generated tone with a variation of the pitch bend 6, the least pitch position to the greatest pitch position.

Thus, once the maximum pitch bend variation range is set in the switch section 5, music is performed by operating the keyboard 1 while operating the pitch bend 6, if desired. When the wheel **6*a* of the pitch bend 6 is operated, the output therefrom is converted in the A/D converter 11 at a predetermined sampling cycle to digital data, which is then processed for data conversion as described before in connection with FIG. 3, thus obtaining the pitch bend data B which is provided from the pitch bend detection section 7**.

Figures 12, 13:
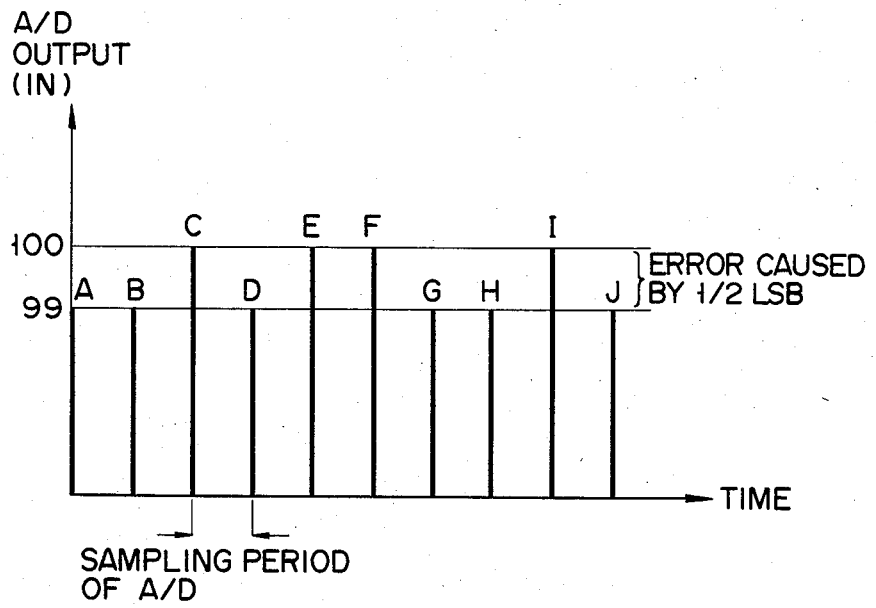
FIG. 12 is a view showing correspondence relation among data in a pitch bend output detection section shown in FIG. 2.
FIG. 13 is a graph showing output variations of an A/D converter when the pitch bend is not operated.

FIG. 12 shows the relationship among data V, A and B for explaining the operation of the pitch bend detection section 7. As is shown, the pitch bend data B is set at the center point "00" when the data V is "7F" and "80", and it is increased in either a negative or positive direction according to the direction of rotation of the wheel **6*b*. When the direction of rotation is such that the data V is reduced from "7F" to "00", the pitch bend data B is increased in the negative direction, i.e., in the direction of reducing the actual pitch variation. When the direction of rotation is such that the data V is increased from "80" to "FF", the data B is increased in the positive direction, i.e., in the direction of increasing the actual pitch variation. In this way, the content of the pitch bend data B is varied according to the actual operation of the pitch bend 6**.

In the pitch data generation section 3, the pitch bend data B noted above is fed to the multiplier 20 to be multiplied by the data $\gamma'_{16}$ from the ROM 19, i.e., in the instant case data "00.061" where the maximum pitch bend variation range corresponds to a one-and-a-half tone. The product $\gamma'_{16}\times B$ thus obtained is fed to the adder 21 to be added to the key code data corresponding to the operated key to obtain the actual pitch data which is fed to the tone generation section 4. The tone generation section 4 produces a tone signal with a pitch bend of cent proportion pitch due to the pitch data provided in the manner as described above. The tone signal is coupled through the D/A converter 8, amplifier 9 and loudspeaker 10 to be sounded as a tone.

FIG. 13 is a view for explaining the effects of an interpolative calculation carried out in the data converter 12. More specifically, the Figure illustrates a case where there is an error in the output data IN of the A/D converter 11 due to the characteristics thereof although the pitch band 6 is not operated or is held at a fixed position. The value of the data IN in this case is "99" at sampling points A, B, D, G, H and J among successive sampling points A to J and "100" at the other sampling points C, E, F and I. In this embodiment, however, the data converter 12 takes an average of values at adjacent sampling points (the decimal fraction being rounded off by the one-half divider 16 through ordinary bit shifting). Thus, the data $V_A$ at point A is 99, data $V_B$ at point B is $V_B=(V_A+V_B)/2=(99+99)/2=99$, data $V_C$ at point C is $V_C=(V_B+V_C)/2=(99+100)/2=99$, and so forth. As is shown, the value of the data is "99" at all points, thus effecting the correction of the error in the A/D converter 11.

Figure 14:
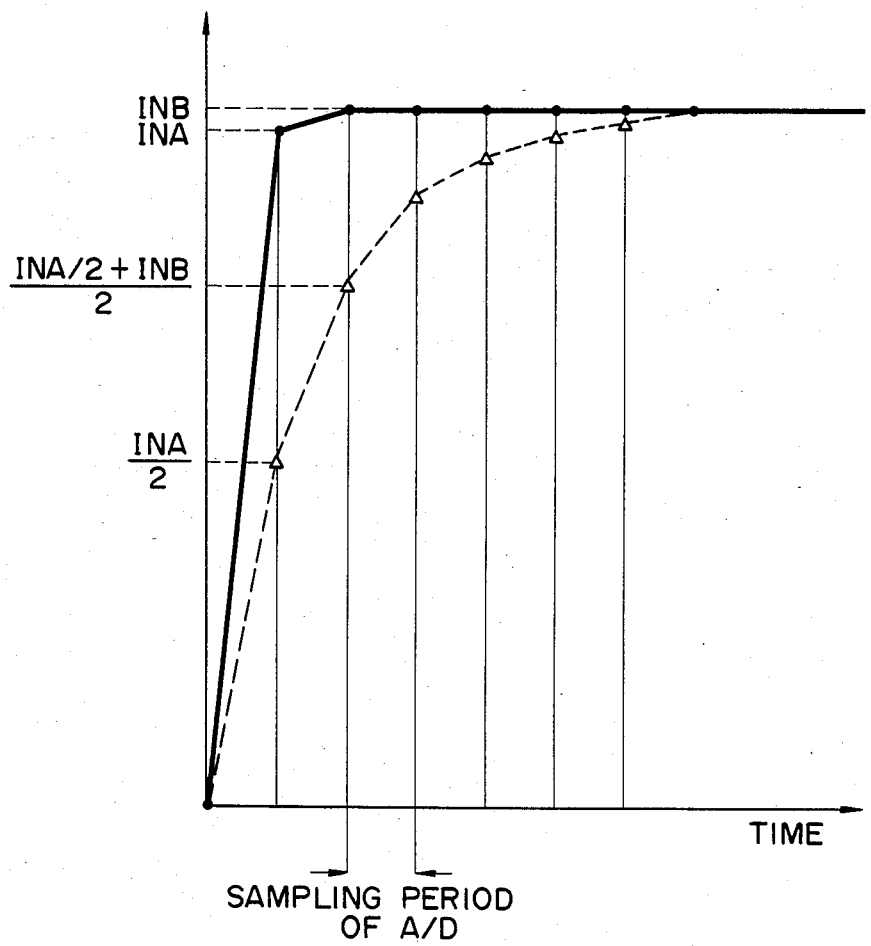
FIG. 14 is a graph showing a digital pitch bend signal varying with time when the pitch bend is quickly operated.

FIG. 14 is a view for explaining the effects of average calculation carried out in the data converter 12. The Figure illustrates a case where the pitch bend 6 is quickly changed. The solid plot in the Figure represents data IN which corresponds to the actual movement of the pitch bend 6. The dashed plot represents the interpolated or corrected data V. The curve of the corrected data V is smooth, because for each sampling point it is the average between the data IN for that point and the result of calculation for the preceding point. Thus, even if the sampling cycle period of the A/D converter 11 is long, the data V varies smoothly with a sudden change in the data IN and has a very low probability of containing errors.

As has been described in the foregoing, with the electronic musical instrument with a pitch bend according to the invention, in which the output of the pitch bend is digitally converted and a tone signal is produced according to a digital signal based on the converted output, a digital signal used for the preceding tone generation and present digital conversion output signal are processed in a predetermined operation to obtain a digital signal for the generation of the present tone. Thus, it is possible to obtain a smooth bend function less subject to errors with a simple construction.

In the explanation in connection with FIG. 3, the coefficients C1 and C2 of the coefficient multipliers 12-1 and 12-5 are both assumed to be 1 for obtaining the average value, but it is obtained a predetermined interpolation value rather than the average value by appropriately changing the values of the coefficients.

Moreover, though an electronic music instrument with a pitch bend is taken as an embodiment, other bender such as a volume bender to bend a tone volume, a vibrato bender to bend the frequency of vibrato, and a filter bender to bend the cut off frequency of a digital filter may be provided in an electronic musical instrument according to this invention.

What is claimed is:

1. An electronic musical instrument with a bender provided separately from performance keys, comprising:

analog/digital converter means having a determined sample period for generating a digital bend signal in accordance with operation of the bender during each said determined sample period;

data converting means for subjecting said digital bend signal to a predetermined data conversion processing to produce a converted digital bend signal; and means for generating a tone corresponding to said converted digital bend signal;

said data converting means including means for performing a predetermined calculation on the converted digital bend signal provided in a preceding period of said analog/digital converter means and the digital bend signal provided in a present period, to generate the converted digital bend signal of the present period and to obtain a converted digital bend signal having a value obtained during each output cycle of said digital bend signal.

2. The electronic musical instrument according to claim 1, wherein said analog/digital converter means includes:

means for generating an analog bend signal; and means for sampling and converting the generated analog bend signal into said digital bend signal for each determined sample period.

3. The electronic musical instrument according to claim 1, wherein said calculating means includes;

a first coefficient multiplier for multiplying the digital bend signal generated in the present period by a first coefficient;

a second coefficient multiplier for multiplying the converted bend signal generated in the preceding period by a second coefficient;

an adder for adding outputs of the first and second coefficient multipliers; and a divider for dividing an output of the adder by a predetermined number.

4. The electronic musical instrument according to claim 3, wherein coefficients of said first and second coefficient multipliers are set as one, respectively; the divider includes a ½ divider for dividing the output of the adder by two; whereby the calculating means calculates an average of the digital bend signal generated in the present period and the converted bend signal in the preceding period.

5. The electronic musical instrument according to claim 1, wherein said analog/digital converter means includes a means for generating a digital pitch bend signal.

6. The electronic musical instrument according to claim 5, wherein said digital pitch bend signal generating means includes means for outputting a maximum variable range designating signal; and said tone generating means includes; means for combining said maximum variable range designating signal and said converted pitch bend signal to generate a combination data representing a pitch bend according to a designated maximum variable range;

a keyboard having a plurality of performance keys;

a means for generating a key code data representing a pitch corresponding to an operated performance key in said keyboard; and a means for generating a pitch data rendered to bend the pitch thereof by combining said key code data and the combination data.

7. The electronic musical instrument according to claim 6, wherein said digital pitch bend signal generating means comprises a means for generating a digital pitch bend signal including a bit representing sign inverting at the middle portion of said maximum pitch bend variable range; and said pitch data generating means includes an adder whose operation is changed between an addition mode in which said key code data and said combination data is added and a subtraction mode in which said key code data is subtracted by said combination data according to a value of said bit.

8. The electronic musical instrument according to claim 7, wherein said pitch data generating means includes means for generating a first code data representing a first frequency of a unit of a semitone and a second code data representing a second frequency of a unit of a predetermined cent.

9. The electronic musical instrument according to claim 8, wherein said tone data generating means includes means for modifying said first code data in accordance with said second code data to obtain a tone frequency data.

10. The electronic musical instrument according to claim 9, wherein said modifying means for obtaining the tone frequency data includes;

a first ROM for outputting a first pitch data according to said first code data;

a second ROM for outputting a binary real data having a value which is cent-proportionated to said second code data; and a calculating means for generating a frequency data by combining said first pitch data and the binary real data.

* * * * *